US005435756A

United States Patent [19]

Takasu

[11] Patent Number: 5,435,756

[45] Date of Patent: Jul. 25, 1995

[54] ADAPTER FOR TWO CORE CABLE

[75] Inventor: Hideki Takasu, Tokyo, Japan

[73] Assignee: The Whitaker Corporation, Wilmington, Del.

[21] Appl. No.: 274,057

[22] Filed: Jul. 12, 1994

[30] Foreign Application Priority Data

Aug. 31, 1993 [JP] Japan ..... 5-051939 U

[51] Int. Cl.[6] ..... H01R 13/40; H01R 17/04

[52] U.S. Cl. ..... 429/658; 439/578; 439/625

[58] Field of Search ..... 439/578, 580, 581, 583, 439/675, 625, 658, 701

[56] References Cited

U.S. PATENT DOCUMENTS

| | | | |
|---|---|---|---|
| 4,163,598 | 8/1979 | Bianchi et al. | 439/581 X |
| 4,693,537 | 9/1987 | Dinsmore et al. | 439/399 |
| 4,842,544 | 6/1989 | Birch et al. | 439/578 X |
| 5,174,775 | 12/1992 | Birch | 439/578 X |

FOREIGN PATENT DOCUMENTS

| | | | |
|---|---|---|---|
| 4138679 | 5/1992 | Japan | 439/578 |
| 2211677 | 7/1989 | United Kingdom | 439/580 |

*Primary Examiner*—William Briggs

*Attorney, Agent, or Firm*—Mary K. VanAtten; Adrian J. LaRue

[57] ABSTRACT

One end of a two-core twisted pair cable 30 having two twisted wires 32 and 34 in a common jacket 36 is prepared. An insert 20 having a pair of semicylindrical halves 22a and 22b connected by a hinge 21 in which a central groove 25 and a branched groove 26 are formed is used. An insert subassembly is prepared by placing one wire 32 connected to the central contact in the central groove 25 of the insert 20, and by placing the other wire 34 in the branched groove 26 and bringing outside its exposed conductor 38. This insert subassembly is inserted in the outer ferrule 13 of the metal shell 12 of the BNC connector 10, after which the ferrule is crimped, thus connecting the conductor 38 to the metal shell 12.

10 Claims, 1 Drawing Sheet

ADAPTER FOR TWO CORE CABLE

FIELD OF THE INVENTION

This invention relates to electrical connectors, especially to adapters used for the connection of such two-core cables as twisted pairs to standard BNC-type connectors.

BACKGROUND OF THE INVENTION

So-called twisted pairs having two insulated wires twisted around each other and placed in an insulating jacket are widely used for transmission of relatively low-frequency signals, such as aural signals, in telephone and other communications systems. Such twisted pairs are usually connected by means of patch connectors.

On the other hand, coaxial cables with a 50 Ohm impedance, having an inner signal conductor located inside a dielectric sleeve wrapped in a braided outer grounding conductor covered by an outer insulating jacket, are usually connected by means of standard coaxial connectors of a BNC type. Since in the coaxial cables the central conductor is surrounded by the grounding conductor, the noise level from the outer conductor or to the outer conductor is minimal over the entire length of the cable and its characteristic impedance is uniform, thereby making it suitable for transmission of high-frequency signals or a wide frequency range signals with minimal distortion. Therefore, they are widely used, together with BNC connectors in high-frequency electronic measuring devices.

BNC connectors are connected to coaxial cables with prepared ends. The preparation consists in removal of the insulating jacket from the end of the cable and exposure of the braided outer conductor to a predetermined length. The inner signal conductor, which is usually a solid wire, is exposed by cutting the outer conductor and the dielectric sleeve to a predetermined length. A needle shaped central contact is connected to this inner signal conductor by soldering or crimping. This central contact is inserted in the central cavity of the insulating housing inside the metal shell of the BNC connector. The connection of the outer conductor of the coaxial cable and the metal shell of the BNC connector is usually carried out by crimping a tubular portion of the metal shell directly to the exposed outer conductor of the coaxial cable, or through a conductive ferrule. The tubular portion of the metal shell is usually crimped to a hexagonal or other polyhedral shape. A rotary spring mounted bayonet-type metal fixture is usually attached to the matching, or front, end of the metal shell.

BNC connectors are preferred means for joining coaxial cables, and the connection operation can be accomplished relatively easy by using special tools. But in some cases, it would be desirable to connect a BNC connector to an end of a twisted cable, wherein the other end is attached to a patch connector. However, since BNC connectors are designed primarily for the use with coaxial cables, their use with two-core cables is extremely difficult. Especially difficult is reliably connecting a two-core cable to a metal shell of a BNC connector.

Therefore, the purpose of this invention is to offer an adapter making it possible to easily and reliably connect a two-core cable to a BNC connector.

SUMMARY OF THE INVENTION

In order to accomplish the above mentioned purpose, in the adapter for two-core cable according to this invention, an insulating insert which is molded as a single unit with a hinge is used which is inserted inside the metal shell of the BNC connector from the back end. This insulating insert has a hinge in the center, and symmetrically arranged parallel grooves. From these parallel grooves, branched grooves are leading outward. When the insert is folded around the hinge, the parallel grooves form a central cavity, and the branched grooves form a cavity leading outward. Insulated wires of a twocore cable with outer jacket removed are placed in the central and the branched cavities of this insulating insert. The tip of the wire located in the central cavity is connected to the central contact of a BNC connector by means of, for example, soldering. The insulation is previously removed from the tips of both wires and the conductors are exposed to a predetermined length. It is desirable that at least the exposed conductor portion of the wire placed in the branched cavity is extended outside the insulating insert.

The insulating insert subassembly with thus attached two-core cable with prepared ends is inserted in the metal shell of a BNC connector from the back side of the BNC connector. The adapter according to this invention is completed by crimping the tubular section of the metal shell to the exposed section of the wire brought out through the branched outlet, using for this purpose conventional tools.

DETAILED DESCRIPTION OF THE INVENTION

Figure 1:
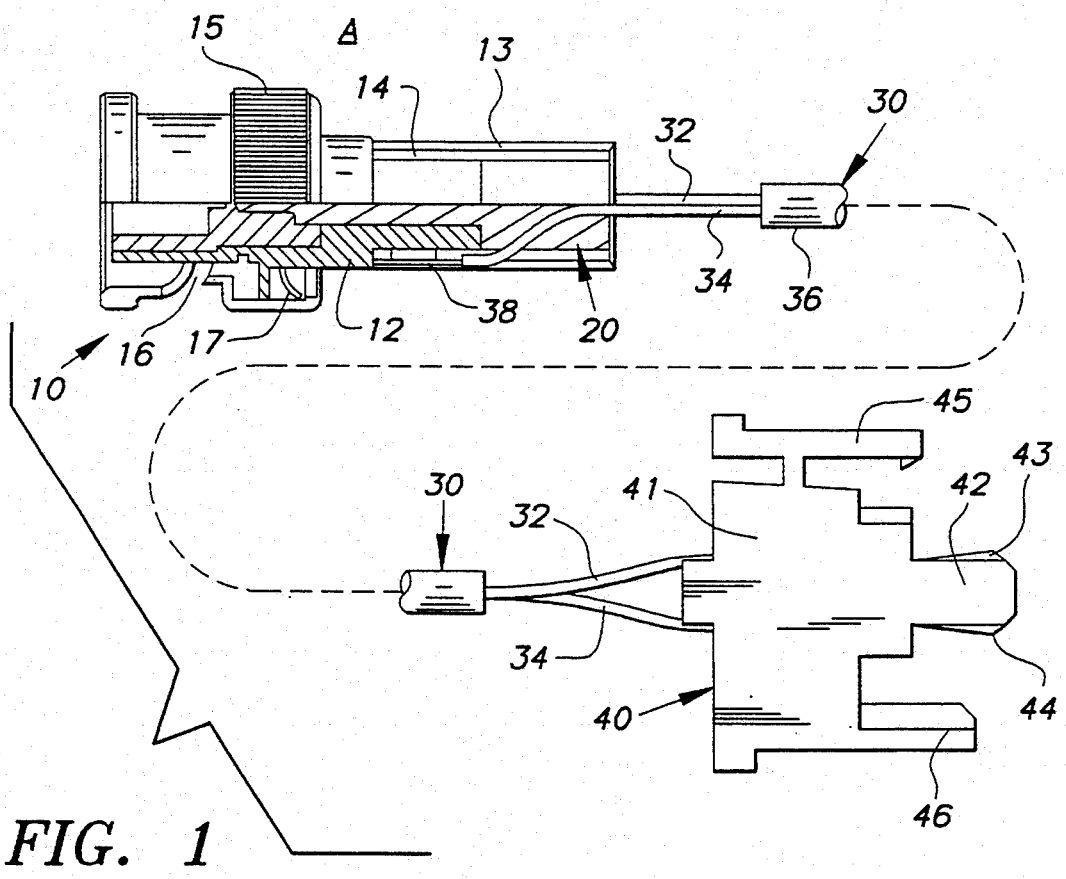
FIG. 1 is a plan view of the preferred embodiment of an adapter for two-core cable according to this invention.

The preferred embodiment of the adapter A according to this invention has a BNC connector 10 known in the art and an insulating insert 20. This adapter A is connected to one end of a two-core twisted pair cable (below, cable) 30, and the other end of the cable may be connected, for example, to a patch connector 40 known in the art. The cable 30 consists of two individually insulated wires 32 and 34 twisted at a certain uniform pitch placed in an insulating sleeve (or a jacket) 36. In order to simplify the drawing, wires 32 and 34 are shown in the FIG. 1 not twisted but parallel.

As known in the art, a BNC connector consists of an outer metal shell 12 made by a mechanical method, a conductive metal outer ferrule 13 fixed to the shell, and a rotating body 15 attached to the front end of the shell 12 in such a manner that it can rotate having a guiding groove 16 for the boss of the bayonet lock. A spring washer 17 installed between this rotating body 15 and the shell 12 provides for a movement of the rotating body within specified limits in the direction of the connector axis. The outer surface of the rotating body 15 is knurled to facilitate its rotation during the use.

Now, we will explain the design of the adapter A used for connection of two wires 32 and 34 to the BNC connector 10. The back portion of the shell 12 forms an internal ferrule of a relatively small diameter, into which an insert 20 is inserted and secured.

Figure 2:
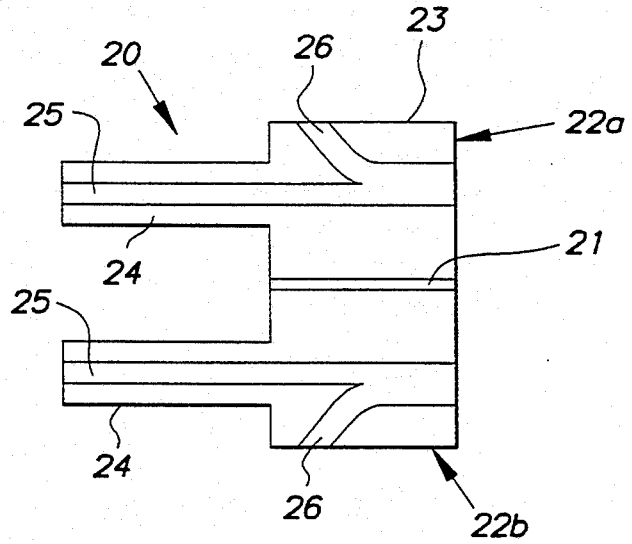
FIG. 2 is an open view of the insert used in the o adapter for two-core cable according to this invention.

The insert 20 has a structure shown in the FIG. 2. It comprises upper and lower symmetrical parts connected in the middle by a thin portion forming a hinge or a web, and it is molded preferably from an insulating plastic as a single unit. The halves, the upper half 22*a* and the lower half 22*b*, of this insert 20 have cylindrical large diameter section 23 in the back, and a cylindrical small diameter section 24 in the front. Along the axis of the upper and lower halves 22*a* and 22*b*, a central groove 25 is formed extending through both the large diameter section 23 and the small diameter section 24. In addition, in the large diameter section 23, a branched groove 26 is made extending from the central groove 25 at an angle.

As shown in the FIG. 2, the central grooves 25 and the branched grooves 26 made in the upper and the lower halves 22*a* and 22*b* are symmetrical relative to the hinge 21. Therefore, when the upper and the lower halves 22*a* and 22*b* are joined together by rotating them around the hinge 21, they form a cylindrical insert 20 consisting of coaxially arranged sections of large diameter and small diameter having central groove 25 and branched groove 26. The central groove 25 runs through the entire length of the insert 20 from the front end to the rear end, and the branched groove 26 has an outlet near the front end the large diameter section 23.

The adapter A is completed as follows: the cable 30 with prepared ends is placed in the insert 20, thus forming an insert subassembly which is inserted in the shell 12 from the back end of the BNC connector. First, the jacket 36 is removed from one end of the cable 30 to a predetermined length. The insulation is stripped off an end of one exposed wire, for example 32, and it is connected to the central contact, not shown in the drawing, for example, by soldering. The end of the other wire, for example 34, is also stripped of the insulation to a predetermined length exposing conductor 38.

Next, the wire 32 is placed in the central groove 25 of, for-example, upper half 22*a* of the insert 20 so that the front end of the central contact extends from the front end of the small diameter section 25. The other wire 34 is placed in the branched groove 26 of the insert 20 so that the exposed conductor 38 extends above the surface of the large diameter section 23 of the insert 20. In this state, the lower half 22*b* is rotated around the hinge 21 to cover the upper half 22*a* to form the above mentioned stepped cylindrical insert subassembly. A conductive cover 14 of preferably ringed shape is placed over the small diameter section.

After that, the insert subassembly is inserted in the cavity of the shell 12 of the BNC connector. In this position, as can be seen from the longitudinal cross section of the FIG. 1, the exposed conductor 38 at the end of the wire 34 is sandwiched between the inner ferrule of the shell 12 and the outer cylindrical ferrule 13. By crimping the outer ferrule 13 with a crimping tool, an electrical connection of the above mentioned conductor 38 to the shell 12 and mechanical connection of the ferrule 13 to the metal shell 12 is accomplished. Thus, the adapter A is completed thereby connecting wires 32 and 34 of the cable 30 electrically and mechanically to the BNC connector.

Using standard methods the central contact is secured in the central groove 25 of the insert 20 preventing its axial movement. Since design of the patch connector 40 attached to the other end of the cable 30 is well known in the art, we do not give its detailed explanation. Shortly, it has a housing 41 molded as a single unit; conductors of the stripped wires 32 and 34 of the cable 30 are connected to springy contacts 43 and 44 located above and below of the protrusion 42 made at the center of the front end of the housing. At one side of the housing 41, there is a see-saw shaped latching arm 45, and a guiding boss 46 at its other side.

Above, we gave explanations concerning the preferred embodiment of an adapter for two-core cable according to this invention. However, this invention is not limited to this embodiment only, but also includes various modifications made as necessary. For example, the outer ferrule of the BNC connector may be made as an integral part of the metal shell, and the inner ferrule may be made as a part of the insert subassembly placed over the small diameter section of the insert. Such an insert subassembly with the inner ferrule placed over it is inserted in the outer ferrule of the BNC connector. If necessary, BNC connectors may be attached to the both ends of the two-core cable.

Using the adapter according to this invention, we can connect one end of two-core twisted pair cable through an insulating insert to a BNC connector, joining one wire to the central contact and the other one to the outer metal shell. This adapter makes it possible to accomplish an easy and inexpensive connection of two-core twisted pair cables to BNC connectors. The other end of the two-core cable may be connected not necessarily to a patch connector, but to another BNC connector or any other required unit.

I claim:

1. An adapter for use in a coaxial connector to electrically connect the connector to a two-core cable wherein the two core-cable has two insulated wires, said adapter comprising:

an insulating insert having a pair of semi-cylindrical halves with a central groove and a branched groove;

one of the wires extends along said central groove and the other of the wires extends along the branched groove, forming an insert subassembly;

said subassembly is secured onto a metal shell of the coaxial connector, the wire in said central groove being electrically connected to a center contact of the coaxial connecter and the wire in said branched groove being electrically connected to said metal shell.

2. The adapter of claim 1, wherein said branched groove is in communication with said central groove.

3. The adapter of claim 1, wherein the wire in said central groove is electrically connected to said central contact by soldering.

4. The adapter of claim 1, wherein said semi-cylindrical halves are connected by a hinge.

5. A coaxial connector for a two-core cable having two insulated wires, comprising:

an outer metal shell and a center contact;

an insulating insert having semi-cylindrical halves including a central groove and a branched groove;

said central groove receiving one of the wires and said branched groove receiving the other of the wires;

and means for securing said insert onto said outer metal shell;

whereby said center contact is electrically connected with the wire in said central groove and said metal shell is electrically connected to the wire in said branched groove.

6. The connector of claim 5, wherein said halves are connected by a hinge.

7. The connector of claim 5, wherein said insert has one section having a smaller diameter than a second section.

8. The connector of claim 5, wherein said central contact is connected to said wire in said central groove by soldering.

9. The connector of claim 5, wherein said means for securing said insert onto said shell comprises crimping a metal ferrule which is attached to said shell.

10. An adapter for use in a coaxial connector to electrically connect the connector to a two-core cable wherein the two-core cable has two insulating wires, said adapter comprising:

an insulating insert having a pair of semi-cylindrical halves having an open and a closed position, said halves being connected by a hinge, and having a central groove and a branched groove;

said central groove receiving one of the wires for connection to a central contact on the coaxial connector and said branched groove receiving the other of the wires for connection to an outer metal shell of said connector; and means for securing said insert onto said shell.

* * * * *